United States Patent [19]

Watson

[11] 4,169,340

[45] Oct. 2, 1979

[54] SUSPENDED CEILING

[75] Inventor: Timothy J. Watson, Peckham Bush, England

[73] Assignee: Matra-Tech Thermal & Acoustic Services Limited, Kent, England

[21] Appl. No.: 878,873

[22] Filed: Feb. 17, 1978

[51] Int. Cl.[2] ..... E04B 5/52

[52] U.S. Cl. ..... 52/774; 52/484

[58] Field of Search ..... 52/484, 489, 773, 774, 52/779, 766, 769, 573, 488, 490

[56] References Cited

U.S. PATENT DOCUMENTS

| | | | |
|---|---|---|---|
| 2,481,794 | 9/1949 | Stitt | 52/773 X |
| 2,617,159 | 11/1952 | Leighton | 52/774 X |
| 2,822,584 | 2/1958 | Urbain | 52/488 X |
| 2,877,878 | 3/1959 | Jantsch | 52/488 |
| 3,693,303 | 9/1972 | Downing, Jr. et al. | 52/476 |
| 3,863,413 | 2/1975 | Mooney | 52/489 X |
| 3,875,717 | 4/1975 | Moeller | 52/774 |

FOREIGN PATENT DOCUMENTS

| | | |
|---|---|---|
| 602489 | 6/1946 | United Kingdom . |
| 585311 | 2/1947 | United Kingdom . |
| 1030796 | 5/1966 | United Kingdom . |
| 1424603 | 2/1976 | United Kingdom . |

*Primary Examiner*—Carl D. Friedman

*Attorney, Agent, or Firm*—Fleit & Jacobson

[57] ABSTRACT

Ceiling panels are supported by parallel members. On one side each member has a flange extending into a slot in each adjacent panel and springs resisting motion of the panels towards the member. On the other side each member has a flange extending into a slot in each adjacent panel. Each panel is supported by two members and is movable against the action of the associated spring of one member in order to release the panel from the other member.

23 Claims, 8 Drawing Figures

SUSPENDED CEILING

This invention relates to suspended ceilings in which ceiling panels are supported by a structure which does not extend below the lower surface of the ceiling panels.

The invention provides a suspended ceiling comprising ceiling panels supported by mutually parallel elongate support members, each support member having on one side a flange extending into a slot in each ceiling panel adjacent that side and spring means resisting motion of each said ceiling panel towards that support member and having on the other side a flange extending into a slot in each ceiling panel adjacent that side, each ceiling panel being supported by two said support members and being movable against the action of the spring means towards one of the said two support members in order to release that panel from the other support member.

The slots in each ceiling panel may be of different depths, the deeper slot being the one adjacent the spring means, but preferably the slots are of equal depth. Furthermore, the panel edges not engaged by the flanges may also have slots of the same depth, these slots preferably receiving elongate stiffening elements. Each stiffening element preferably comprises a flange which extends into a said slot and a web which abuts against the edge of the panel, and preferably has a further flange abutting against the upper face of the panel. The stiffening elements preferably extend to the ends of the slots and rest on the flanges of the support members.

Preferably each support member comprises an inverted tee-section, the flange associated with the spring means preferably being wider than the opposite flange. The edge of each ceiling panel opposite the spring means may abut against an abutment surface integral with the adjacent support member or an abutment surface provided by an elongate spacing element, which may conveniently be in the form of a metal channel section and which rests on the associated flange.

The invention also provides a ceiling panel support member as defined above, for use in the suspended ceiling according to the present invention.

The invention will be described further, by way of example only, with reference to the accompanying drawings, in which.

Figure 1:
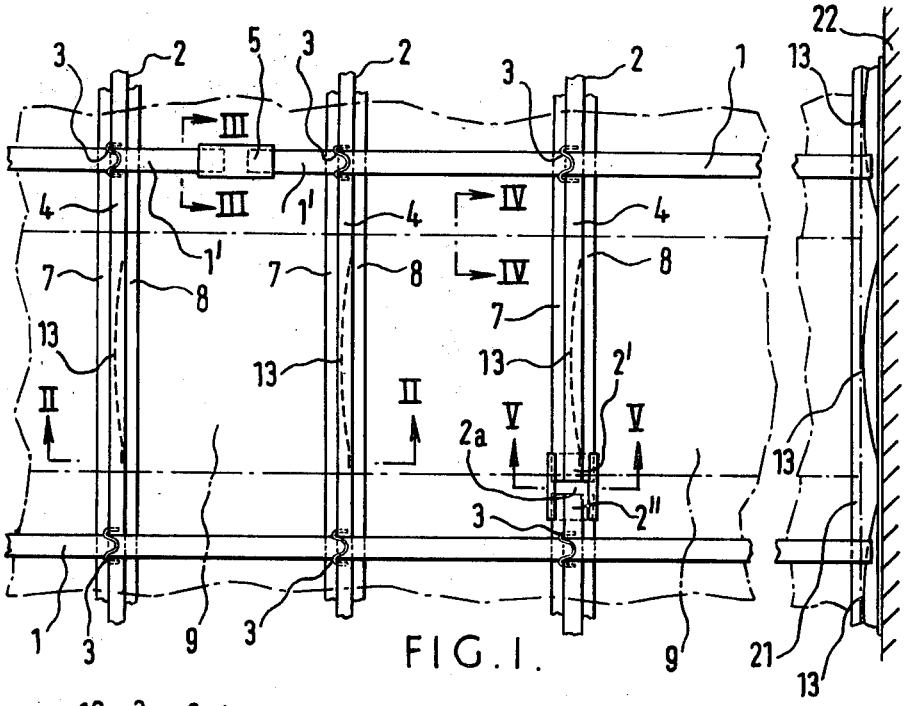
FIG. 1 is a diagrammatic plan view of a suspended ceiling.

The suspended ceiling illustrated comprises bearers or channels 1 which extend across a room of a building and are suspended (by conventional means, not shown) from the building structure. Ceiling panel support members 2 extend transversely of the channels 1 and are fixed to them by clips 3. Each support members 2 is in the form of an inverted tee-section whose web has as its free end a flange 4 which rests against the channel 1 and is engaged by the clip 3. The flange 4 is formed with a ridge 6 which assists retention of the clips 3. The bottom of each support member 2 has two flanges 7,8 of unequal width.

The channels 1 consist of channel-lengths 1' connected end-to-end by channel-section connectors 5 of spring steel which fit over the adjacent ends of the lengths 1' and are retained by lips **5*a*,5*b*. The ends of the lengths 1' abut against plastics stops 5*c* plugged into the connectors 5. In the event of fire, the lengths 1' are free to expand, shearing the stops 5*c*. Each channel 1 has an equally spaced series of pairs of locating lugs 10 stamped out of the lower flange of the channel 1. The upper flange 4 of a support member 2 is located between each pair of lugs 10. The support members 2 consist of individual lengths 2' connected end-to-end by channel-section connectors 15 of spring steel which fit into the adjacent ends of the lengths 2' between the upper flange 4 and the wider flange 7. The ends of the lengths 2' are spaced apart to allow for thermal expansion, the space being covered by an external cover 2*a***.

Figure 4:
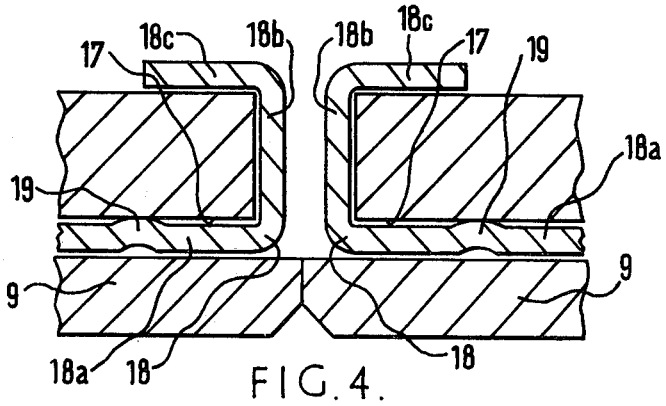
FIG. 4 is a section on line IV—IV in FIG. 1 on an enlarged scale.
Figure 5:
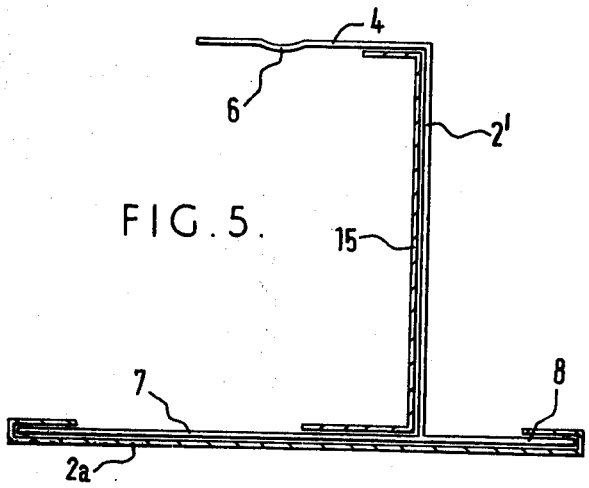
FIG. 5 is a section on line V—V in FIG. 1 on an enlarged scale.
Figure 7:
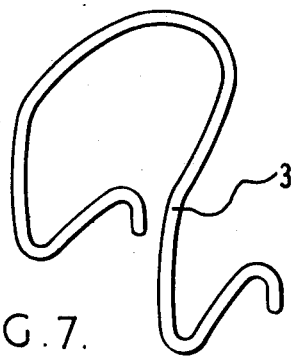
FIG. 7 is a perspective view of a clip on an enlarged scale.
Figure 6:
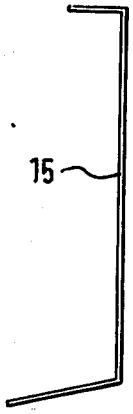
FIG. 6 is an end view of the connector seen in FIG. 5, but in the unstressed state.

Ceiling panels 9 are mounted between, and supported by, the support members 2. The wider flange 7 extends part-way into a slot 11 in each associated ceiling panel 9. The narrower flange 8 extends substantially to the bottom of a slot 12, equal in depth to the slot 11, in each associated ceiling panel 9. Thus each ceiling panel has a slot 11 and a slot 12, at opposite edges. The other two edges of each panel 9 also have slots 17, which are equal in depth to the slots 11 and 12, so that all the edges are equivalent. To provide the edges with adequate strength to support the panel, the panel thickness above each slot is made greater than the panel thickness below each slot. Furthermore, the slots 17 of each panel receive longitudinal stiffening elements 18 (FIG. 4) which extend to the ends of the slots 17 and rest on the flanges 7,8 of the support members 2 (see FIG. 2). Each element 18 is a channel-section element, one flange **18*a* of which extends into the associated slot 17 and has a ridge 19 for retaining it in the slot. The web 18*b* abuts against the edge of the panel, which is rebated above the slot. The other flange 18*c*** abuts against the upper face of the panel.

Figure 2:
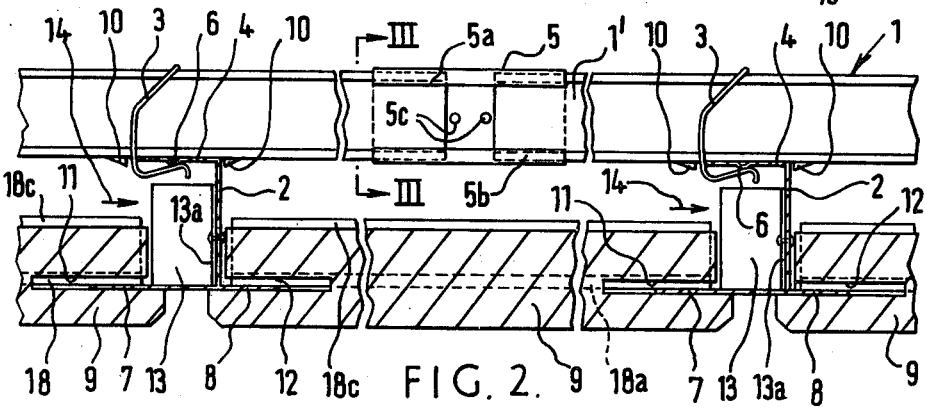
FIG. 2 is a section on line II—II in FIG. 1, on an enlarged scale.
Figure 3:
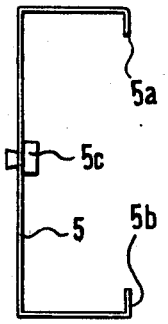
FIG. 3 is an end view of a channel connector taken of line III—III in FIG. 1 and FIG. 2, but in the unstressed state.
Figure 8:
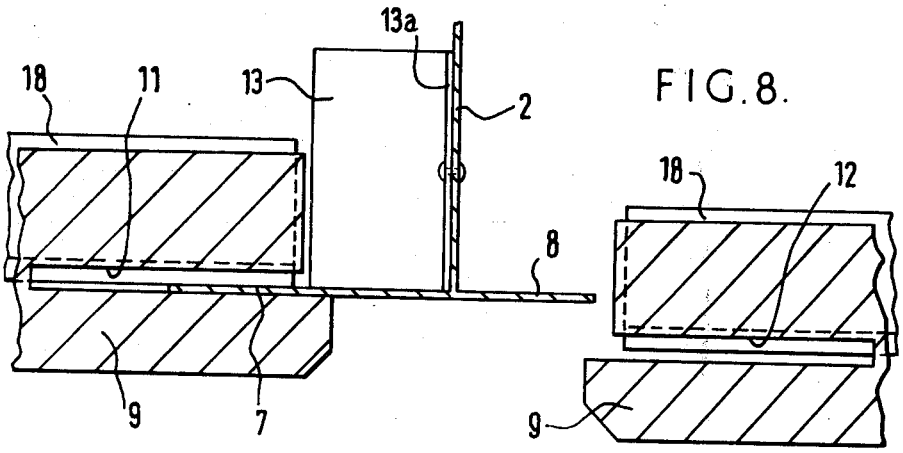
FIG. 8 is a section through the ceiling illustrating the removal of a ceiling panel.

Associated with the wider flange 7 of each support member are a number of bow springs 13 (one per panel 9), each having at one end a flange **13*a* which is connected to the support member 2 by a rivet so that the spring 13 is free to be flattened from the position shown in FIGS. 1 and 2 to that shown in FIG. 8. Each bow spring 13 resists motion (in the direction of arrow 14) of the associated ceiling panel 9 towards the support member 2, and preferably exerts a force on the panel such that its opposite edge is urged (according to arrow 16) against the web of the other support member 2 supporting the panel. Bow springs 13 are also mounted on an angle-section edge trim 21 fixed to one wall 22 of the room to be provided with the suspended ceiling. Bow springs (not shown) are similarly provided on the two walls adjacent the wall 22, in order to apply pressure to the panels 9 in a direction parallel to the support members 2. The fourth wall (opposite the wall 22**) is provided with an edge trim without bow springs.

To release a panel 9 from the two support members 2 between which it is mounted, the panel 9 is moved to the right (as viewed in FIGS. 1 and 2), thus flattening the associated bow springs 13 (see FIG. 8), until the slot 12 is free of the flange 8. The panel 9 is then tilted down until its edge lies completely below the flange 8, whereupon it is moved to the left in order to release the slot 11 from the flange 7.

The ceiling panel 9 can be replaced by following the above procedure in reverse.

Various modifications may be made within the scope of the invention. For instance: the slot 12 may be made shallower than the slot 11; a spacing element (e.g. a metal channel-section) may be placed on the flange 8 between the panel 9 and the web of the support member 2; there may be two (or more) bow springs 13 to each panel 9.

The suspended ceiling described above enables one to gain access to the space above the ceiling at any point quickly and easily, without having to remove a large area of the ceiling. This is particularly important in hospitals and in buildings in which computers and complex electrical equipment are to be installed.

I claim:

1. A suspended ceiling comprising mutually parallel elongate support members, and ceiling panels supported by the support members, each support member having on one side a flange extending into a slot in each ceiling panel adjacent that side and spring means for resisting motion of each said ceiling panel towards the support member and having on the other side a flange extending into a slot in each ceiling panel adjacent that side, each ceiling panel being supported by two said support members and being movable against the action of the spring means towards one of the said two support members in order to release that panel from the other support member.

2. The suspended ceiling of claim 1, in which the slots in the opposite edges of each panel are of equal depth.

3. The suspended ceiling of claim 1, in which the panel thickness above the slots is greater than that below the slots.

4. The suspended ceiling of claim 1, in which, above each slot, the panel edge is rebated.

5. The suspended ceiling of claim 1, in which the said slots in each panel communicate with further slots in the panel edges transverse to the support member.

6. The suspended ceiling of claim 5, including elongate stiffening elements received by the said further slots, each stiffening elements free of interconnection with adjacent panels.

7. The suspended ceiling of claim 6, in which each stiffening element comprises a flange which extends into the associated slot and a web which abuts against the edge of the panel.

8. The suspended ceiling of claim 7, in which each stiffening element includes a further flange which abuts against the upper face of the panel.

9. The suspended ceiling of claim 6, in which the stiffening elements extend to the ends of the said further slots and rest on the flanges of the support members.

10. The suspended ceiling of claim 5, in which the edges of each panel are all of identical cross-sectional shape.

11. The suspended ceiling of claim 1, in which each support member comprises an inverted tee-section.

12. The suspended ceiling of claim 1, in which the flange associated with the spring means is wider than the opposite flange.

13. The suspended ceiling of claim 1, in which the edge of each ceiling panel opposite the spring means abuts against an abutment surface integral with the adjacent support member.

14. The suspended ceiling of claim 1, in which the edge of each ceiling panel opposite the spring means abuts against an elongate spacing element resting on the associated flange of the adjacent support member.

15. The suspended ceiling of claim 1, including transverse elongate bearers to which the support members are connected.

16. The suspended ceiling of claim 15, in which the upper end of each support member has a flange, further comprising clips connecting the flanges to the bearers.

17. The suspended ceiling of claim 16, in which each support member consists of individual lengths connected end-to-end, further comprising channel-section connectors which fit between the upper flange and one of the lower flanges of the support member in order to connect the individual lengths.

18. The suspended ceiling of claim 15, in which each support member is located between a pair of lugs on each bearer.

19. The suspended ceiling of claim 15, in which each bearer is a channel.

20. The suspended ceiling of claim 19, in which the channel consists of channel lengths, further comprising channel-section connectors which fit over the channel and have lips which retain them on the channel in order to connect the channel lengths.

21. The suspended ceiling of claim 1, in which the spring means comprise bow springs.

22. The suspended ceiling of claim 21, in which there is one bow spring per panel.

23. The suspended ceiling of claim 21, in which one end of each bow spring is fixed to the associated support member.

* * * * *